US007012207B2

(12) United States Patent
Yahagi et al.

(10) Patent No.: US 7,012,207 B2
(45) Date of Patent: Mar. 14, 2006

(54) SWITCH FOR ELECTRIC TOOL

(75) Inventors: Hiroyuki Yahagi, Tokyo (JP); Isao Inagaki, Tokyo (JP)

(73) Assignee: Satori S-Tech Co., Ltd., Tokyo (JP)

( * ) Notice: Subject to any disclaimer, the term of this patent is extended or adjusted under 35 U.S.C. 154(b) by 0 days.

(21) Appl. No.: 10/853,124

(22) Filed: May 26, 2004

(65) Prior Publication Data

US 2004/0251119 A1 Dec. 16, 2004

(30) Foreign Application Priority Data

May 28, 2003 (JP) ..... 2003-150728

(51) Int. Cl.
*H01H 9/06* (2006.01)

(52) U.S. Cl. ..... 200/332.2; 200/559; 200/329; 200/283

(58) Field of Classification Search ..... 200/332.2, 200/329–330, 237–238, 16 D, 16 R, 402, 200/283, 559
See application file for complete search history.

(56) References Cited

U.S. PATENT DOCUMENTS 4,278,855 A * 7/1981 Rossi ..... 200/407
4,581,509 A * 4/1986 Sanford et al. ..... 200/83 P
4,873,403 A * 10/1989 Counts et al. ..... 200/330
6,483,063 B1 * 11/2002 Chu ..... 200/547

FOREIGN PATENT DOCUMENTS

JP 2003-086302 3/2003

* cited by examiner

*Primary Examiner*—Kyung Lee
(74) *Attorney, Agent, or Firm*—Wenderoth, Lind & Ponack, L.L.P.

(57) ABSTRACT

To electrically connect switch terminals of a housing and a control member in a switch for an electric tool with ease and to prevent the electric connection from becoming incomplete even when vibration occurs, elastic bodies for maintaining an electric connection are interposed between the control member and the switch terminals so that the control member and the switch terminals can maintain a stable connection even when vibration is imparted to the housing.

4 Claims, 7 Drawing Sheets

SWITCH FOR ELECTRIC TOOL

BACKGROUND OF THE INVENTION

1. Field of the Invention

The present invention relates to a switch for an electric tool that is fitted to the electric tool and turns ON and OFF power of the electric tool.

2. Related Art

A general method of electrically connecting a control member to a housing of a conventional switch in the switch for an electric tool will be explained with reference to FIGS. 6 to 9. As shown in FIGS. 6 and 7, a control member 5 having a power control element 4 is fitted into a control member accommodation portion 3 defined in a housing 2 of a switch main body 1 in a switch for an electric tool.

The housing 2 and the control member 5 are electrically connected to each other by soldering a connection portion 6*a* of a heat radiation plate 6 connected to an anode terminal of the power control element 4 provided to the control member 5 to the switch terminal 7 of the housing 2 while the control member 5 is fitted into the control member accommodation portion 3 of the housing 2 as shown in FIGS. 8 and 9 and also soldering a cathode terminal 8 of the power control element 4 to a switch terminal 9 of he housing 2.

Examples of a method of electrically connecting a terminal to another without using soldering include the following method. In a connector for connecting a connection object to signal contacts with rotation of a cover, including the signal contacts, a housing for holding the signal contacts and the cover for holding the connection object, the housing has a switch portion, the cover has a spring plate undergoing elastic displacement when it is pushed by the connection object held and when undergoing elastic displacement, the spring plate operates the switch portion with the rotation of the cover (refer to JP-A-2003-86302).

When electric connection between the housing 2 and the control member 5 is made by soldering in the prior art technology described above, however, heat generated by soldering sometimes melts a resin portion forming the housing 2 and a working factor is low, too. In electric tools that generate vibration, vibration invites the occurrence of cracks at the soldering portion and electric connection between the housing 2 and the control member 5 becomes incomplete in some cases. Therefore, it is necessary to fix the power control element 4 of the control member 5 and the heat radiation plate 6 to the housing 2 by use of an adhesive, etc, and an assembly process gets complicated as much.

Therefore, the switches for the electric tool according to the prior art are yet required to achieve easy electric connection between the housing and the control member and to prevent the electric connection from becoming incomplete even when vibration or the like occurs.

SUMMARY OF THE INVENTION

To accomplish the object described above, the present invention provides a switch for an electric tool having a control member arranged in a housing and electrically connected to a switch terminal disposed in the housing, wherein an elastic bodies for keeping electric connection are interposed between the control member and the switch terminals so that the control member and the switch terminals can keep stable connection even when vibration is imparted to the housing.

The present invention includes additional requirements that the elastic body is a leaf spring and that the control member comprises a power control element to which a heat sink is connected.

Because the elastic bodies for keeping electric connection are interposed between the control member and the switch terminals so that the control member and the switch terminals can keep stable connection even when vibration is imparted to the housing in the switch for the electric connection according to the invention, it is possible to connect easily and electrically the housing and the control member and to prevent this electric connection from becoming incomplete even when vibration or the like occurs.

DETAILED DESCRIPTION OF PREFERRED EMBODIMENT

Figure 1:
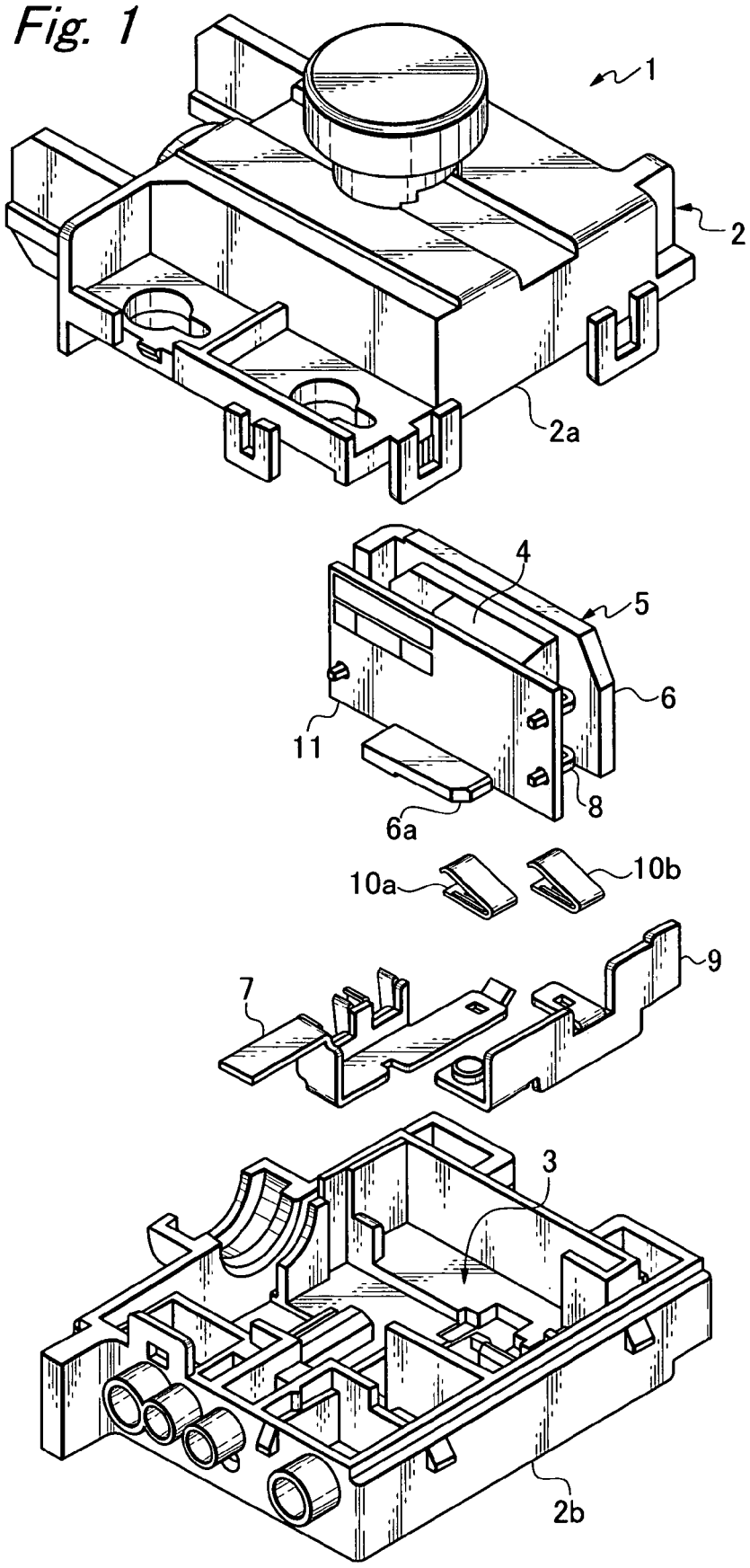
FIG. 1 is an exploded perspective view showing constituent members of a switch for an electric tool according to an embodiment of the invention.

A switch for an electric tool according to the embodiment will be explained with reference to FIGS. 1 to 5. Like reference numerals will be used throughout the drawings to identify like constituent elements according to the prior art described above so as to have the drawings more easily understood.

Referring FIG. 1, a housing 2 constituting a switch main body 1 is divided into an upper member 2*a* of the housing 2 and its bottom member 2*b*. A control member accommodation portion 3 is defined in the bottom member 2*b* of the housing 2. Switch terminals 7 and 9 to be electrically connected to a trigger switch (not shown) are arranged at predetermined positions of the control member accommodation portion 3. When the trigger switch is operated, the switch for the electric tool can turn ON and OFF the power source.

Figure 2A:
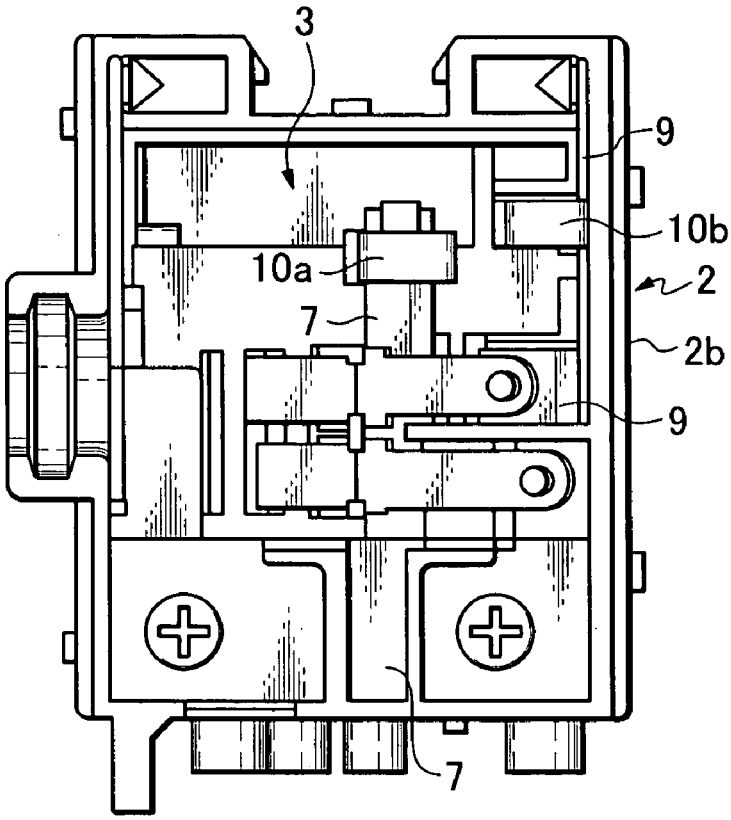
FIG. 2(*a*) is a plan view showing a bottom member of a housing of the switch for the electric tool and FIG. 2(*b*) is a bottom plan view of a control member of the switch for the electric tool.
Figure 2B:
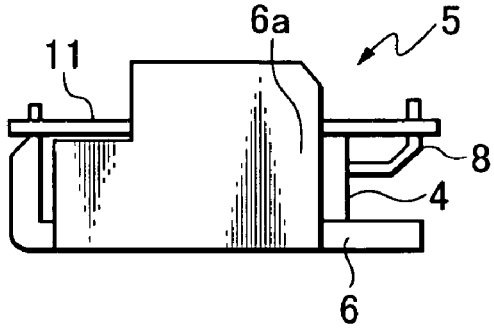

Referring FIG. 2(*a*), elastic bodies 10*a* and 10*b* are arranged at switch terminals 7 and 9. A leaf spring, for example, can be used as each of the elastic bodies 10*a* and 10*b*.

Referring FIG. 2(*b*), a control member 5 arranged in the control member accommodation portion 3 includes a power control element 4, a heat radiation plate 6 and a printed wiring board 11 and is connected to the printed wiring board 11 while the heat radiation plate 6 and an anode terminal of the power control element 4 are connected. A silicon control rectifier (SCR) or a tri-AC (triode AC switch), for example, can be used for the power control element 4.

A lower part of the heat radiation plate 6 is so bent as to form a connection portion 6*a*. In other words, since the heat radiation plate 6 and the anode terminal of the power control element 4 are electrically connected, the connection portion 6*a* can be regarded as the anode terminal of the power control element 4.

When the power control element 4 is connected to the printed wiring board 11, the cathode terminal 8 of the power control element 4 is bent and is connected to the printed wiring board 11.

Figure 3:
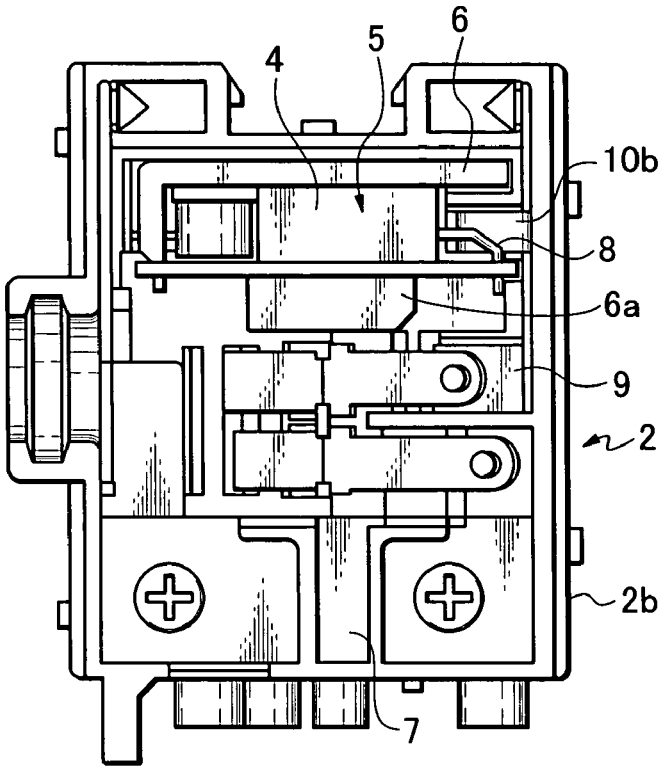
FIG. 3 is a plan view when the control member is arranged in a control member accommodation portion defined in the bottom member of the housing of the switch for the electric tool.

As shown in FIG. 3, the control member 5 is arranged in the control member accommodation portion 3 defined in the bottom member 2*b* of the housing 2. The control member accommodation portion 3 is defined in such a fashion that the control member 5 can exactly fit into the control member accommodation portion 3.

Figure 4:
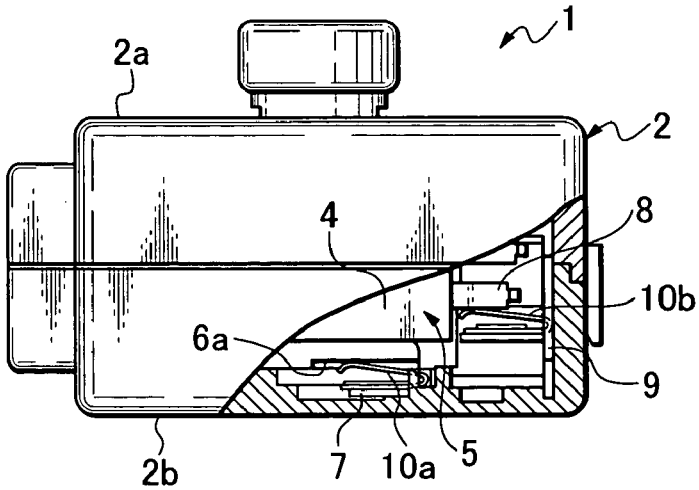
FIG. 4 is a partially cutaway side view showing a switch main body of the switch for the electric tool.

As shown in FIG. 4, the connection portion 6*a* of the heat radiation plate 6 connected to the anode terminal of the power control element 4 provided to the control member 5 and the switch terminal 7 provided to the housing 2 are electrically connected to each other through the elastic body 10*a* and the bent cathode terminal 8 of the power control device 4 and the switch terminal 9 provided to the housing 2 are electrically connected to each other through the elastic body 10*b*.

Figure 5:
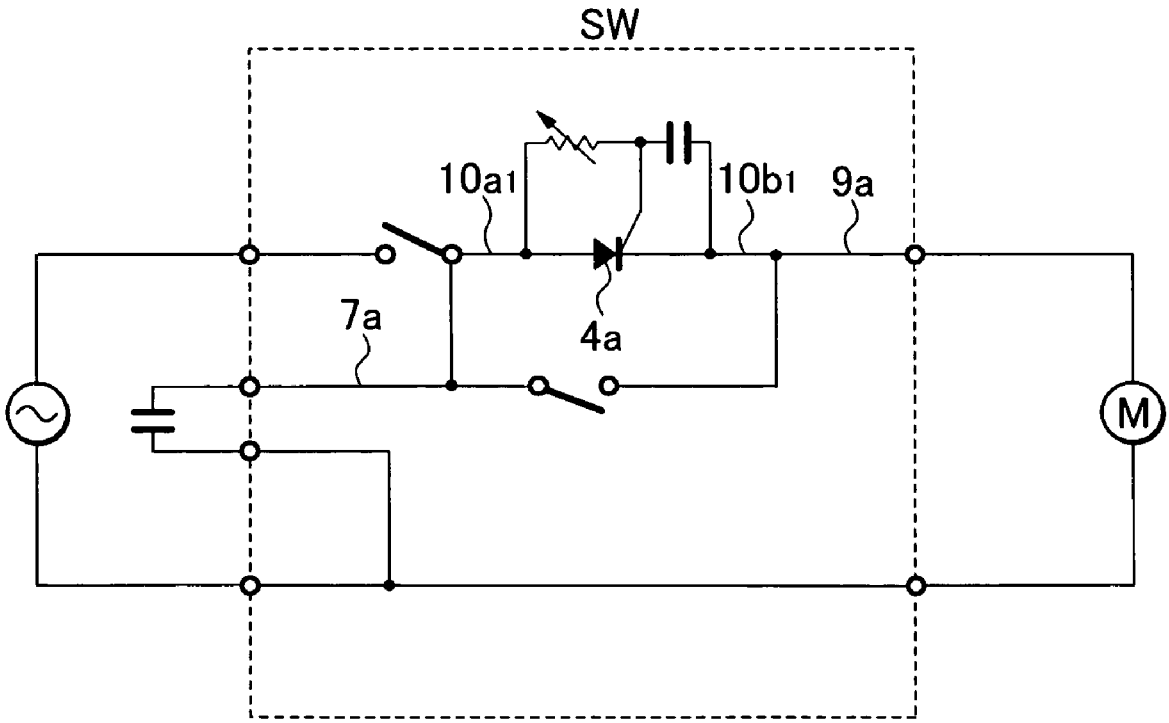
FIG. 5 is a circuit diagram of the switch for the electric tool.
Figure 6:
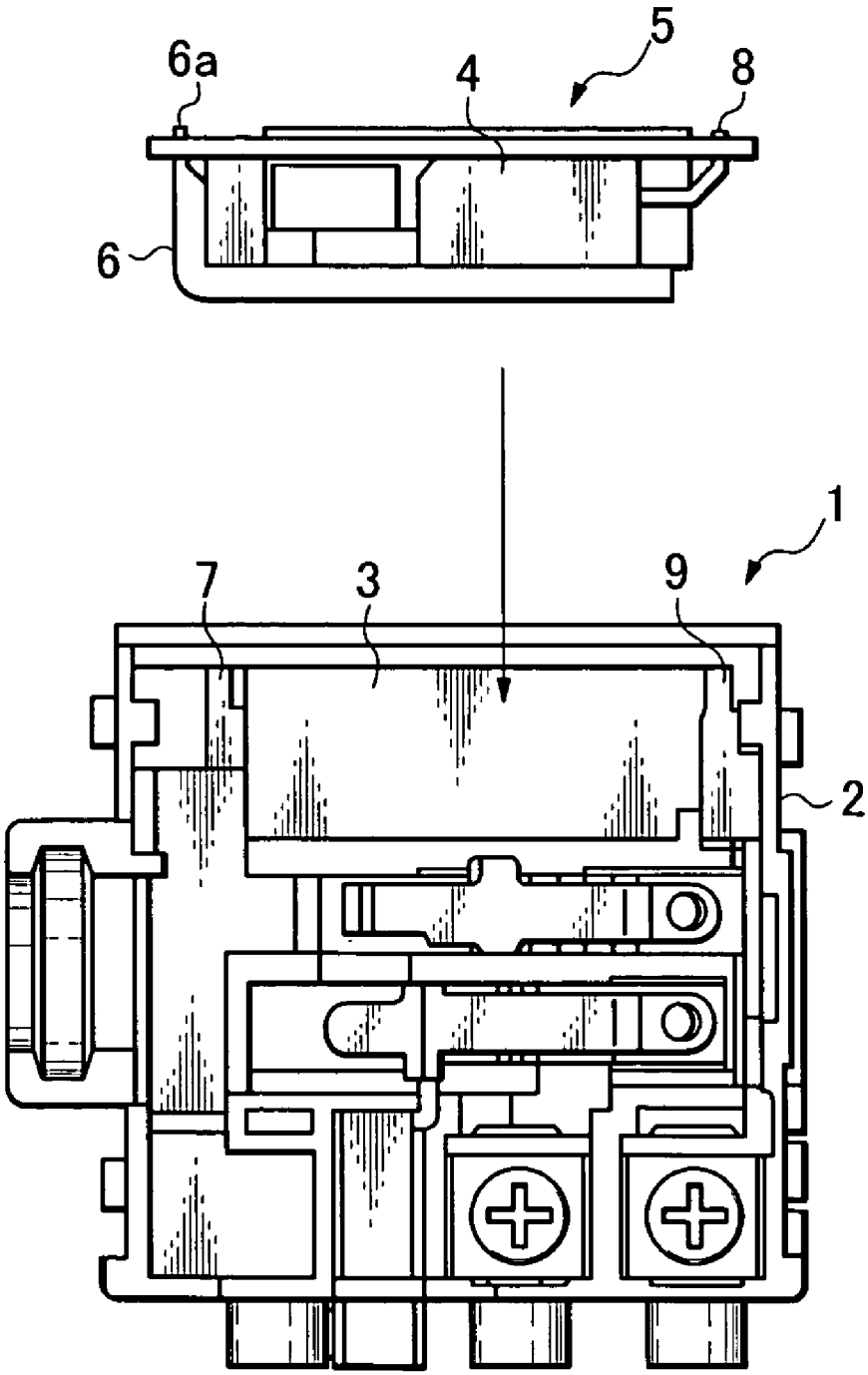
FIG. 6 is a plan view showing a bottom member of a housing of a conventional switch for an electric tool.
Figure 7:
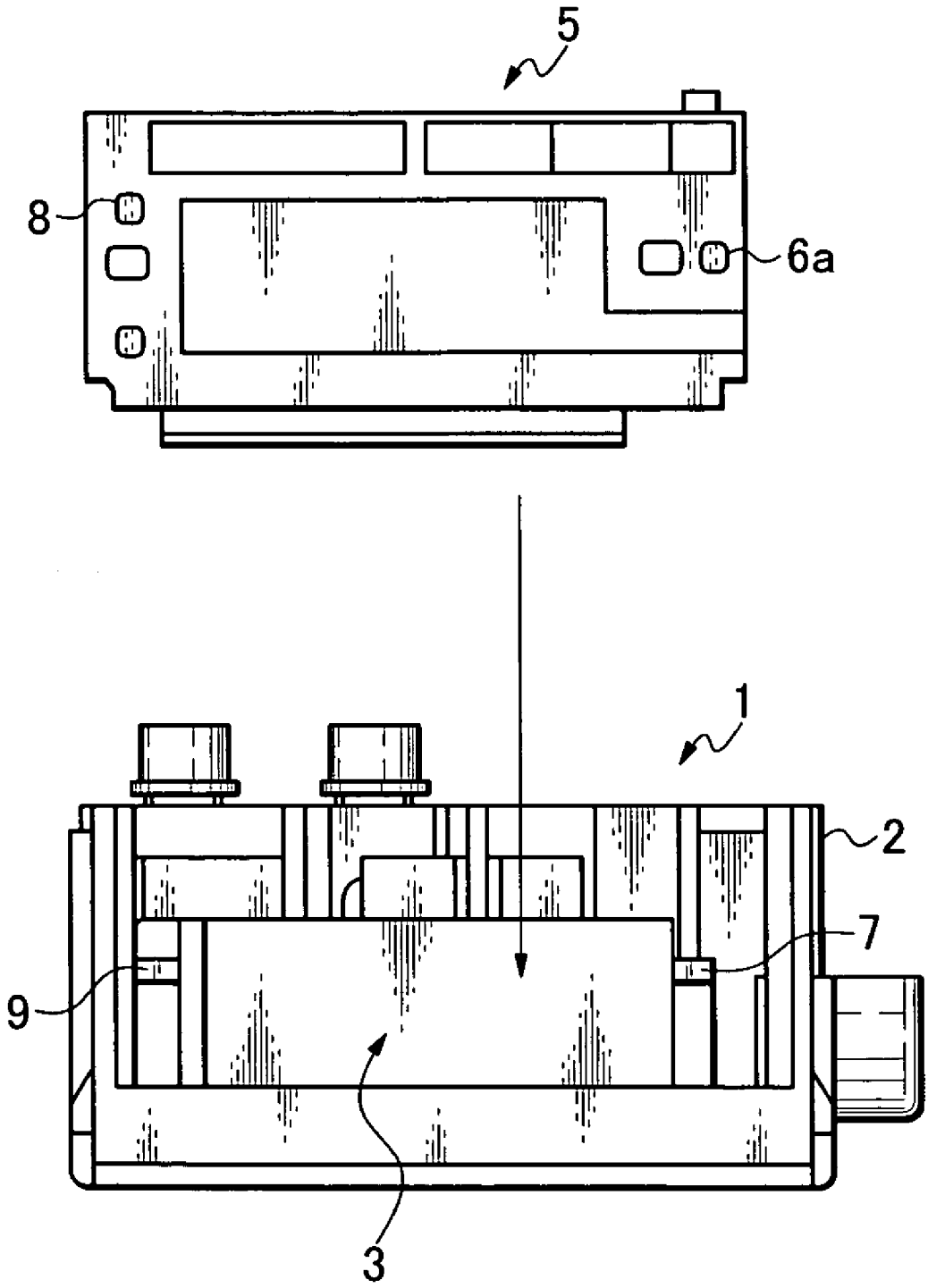
FIG. 7 is a side view of the bottom member of the housing of the switch for the electric tool.
Figure 8:
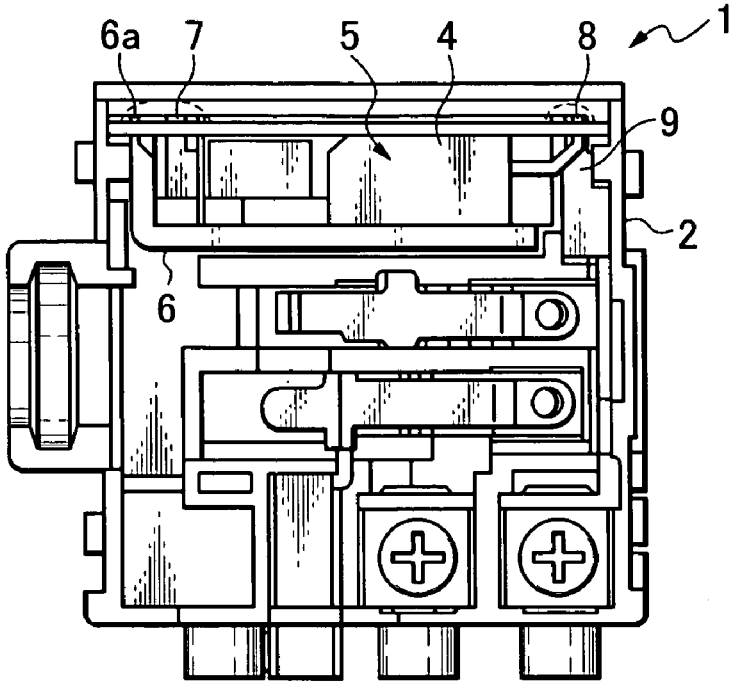
FIG. 8 is a plan view showing the state where the control member is arranged in the control member accommodation portion defined in the bottom member of the housing of the switch for the electric tool.
Figure 9:
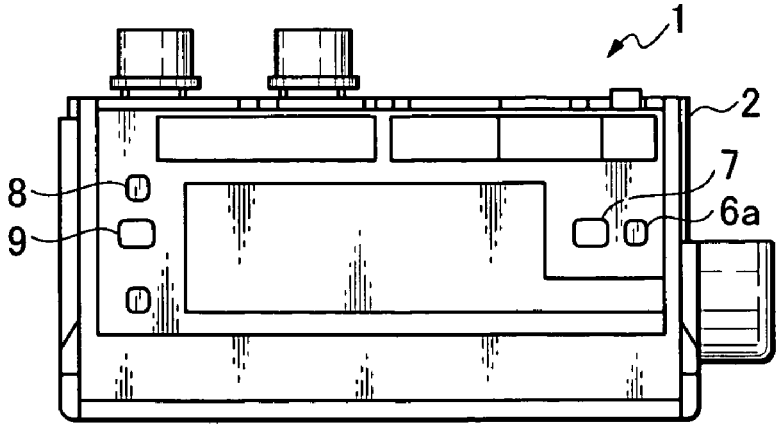
FIG. 9 is a side view showing the state where the control member is arranged in the control member accommodation portion defined in the bottom member of the housing of the switch for the electric tool.

FIG. 5 shows a simple circuit diagram of the switch for the electric tool. In the circuit diagram, symbol SW encompassed by doted line represents the switch for the electric tool and the rest of the circuits represent circuits such as a motor connected to the switch for the electric tool.

The anode terminal of the power control element 4*a* is connected to the switch terminal 7*a* through the elastic body $\mathbf{10}a_1$ and the cathode terminal of the power control element 4*a* is connected to the switch terminal 9*a* through the elastic body $\mathbf{10}b_1$.

As described above, the switch terminals 7 and 9 of the housing 2 are electrically connected to the control member 5 by interposing the elastic body 10*a* between the switch terminal 7 of the housing 2 and the connection portion 6*a* that replaces the anode terminal of the power control element 4 provided to the control member 5 and the elastic body 10*b* between the switch terminal 9 of the housing 2 and the cathode terminal 8 of the power control element 4 and in this way, the housing 2 and the control member 5 can be connected easily and electrically.

Therefore, even when the switch is used as a switch for a device such as an electric tool that generates vibration, cracks do not occur unlike the case where connection is made by soldering, and the switch can keep stable electric connection and can prevent the electric connection from becoming incomplete.

In other words, even when the weight of the control member 5 increases due to the presence of the heat radiation plate 6 and a moment of large force acts on the control member 5 due to the vibration, the elastic bodies 10*a* and 10*b* absorb the vibration. When the switch is used for the electric tool and the vibration is imparted to the housing 2 of the switch for the electric tool, the elastic bodies 10*a* and 10*b* keep the connection between the control member 5 and the switch terminals 7 and 9 under the stable condition. Therefore, though the housing 2 and the heat radiation plate 6 are not bonded, conduction between the housing 2 and the control member 5 is not cut off.

The embodiment given above represents the case where the control member 5 is directly arranged in the control member accommodation portion 3 defined in the bottom member 2*b* of the housing 2. However, because connection between the switch terminals 7 and 9 of the housing 2 and the control member 5 does not need soldering but can be easily made through the elastic bodies 10*a* and 10*b*, it is possible, for example, to bring the control member 5 and the upper member 2*a* of the housing 2 into the combined state and then to combine the bottom member 2*b* on which the elastic bodies 10*a* and 10*b* are arranged with the upper member 2*a* of the housing 2.

As explained above, the switch for the electric tool according to the invention is the switch that includes the control member arranged in the housing and electrically connected to the switch terminals disposed in the housing, and the elastic bodies for keeping electric connection are interposed between the control member and the switch terminals so that the control member and the switch terminals can keep stable connection even when vibration is imparted to the housing. Therefore, the housing and the control member can be easily connected. Even when vibration is imparted to the switch for the electric tool, cracks do not occur unlike the case where connection is made by soldering, and electric connection can be kept stably and can be prevented from becoming incomplete.

What is claimed is:

1. A switch for an electric tool comprising:

a housing having connecting terminals disposed therein; and a control unit including a power control element, a heat radiation plate and a printed wiring board, wherein said control unit is arranged in said housing and is electrically connected to said connecting terminals, and wherein a plurality of elastic, electrically conductive members for maintaining an electric connection are interposed between said control unit and said connecting terminals so that said control unit and said connecting terminals maintain a stable connection therebetween even when vibration is imparted to said housing.

2. A switch for an electric tool according to claim 1, wherein each of said elastic, electrically conductive members is a leaf spring.

3. A switch for an electric tool according to claim 1, wherein said heat radiation plate of said control unit is a heat sink connected to said power control element.

4. A switch for an electric tool according to claim 1, wherein said power control element of said control unit has an anode terminal electrically connected to said heat radiation plate, wherein said heat radiation plate is electrically connected to one of said connecting terminals via one of said elastic, electrically conductive members, and wherein a cathode terminal is electrically connected to an other of said connecting terminals via an other of said elastic, electrically conductive members.

* * * * *